US008235104B1

(12) United States Patent
Sigmar et al.

(10) Patent No.: US 8,235,104 B1
(45) Date of Patent: Aug. 7, 2012

(54) APPARATUS FOR PIPE TONG AND SPINNER DEPLOYMENT

(75) Inventors: Axel Sigmar, Tomball, TX (US); Keith J. Orgeron, Tomball, TX (US)

(73) Assignee: T&T Engineering Services, Inc., Tomball, TX (US)

( * ) Notice: Subject to any disclaimer, the term of this patent is extended or adjusted under 35 U.S.C. 154(b) by 186 days.

(21) Appl. No.: 12/633,913

(22) Filed: Dec. 9, 2009

Related U.S. Application Data

(60) Provisional application No. 61/138,396, filed on Dec. 17, 2008.

(51) Int. Cl.
*E21B 19/18* (2006.01)
*E21B 19/16* (2006.01)

(52) U.S. Cl. ..... 166/77.51; 166/380; 166/85.1; 166/78.1

(58) Field of Classification Search ..... 166/77.51, 166/380, 85.1, 78.1; 414/22.51
See application file for complete search history.

(56) References Cited

U.S. PATENT DOCUMENTS 3,177,944 A 4/1965 Knights
3,280,920 A 10/1966 Scott
3,365,762 A 1/1968 Spiri
3,464,507 A 9/1969 Alexander et al.
3,561,811 A 2/1971 Turner, Jr.
3,633,771 A 1/1972 Woolslayer et al.
3,702,640 A 11/1972 Cintract et al.
3,806,021 A 4/1974 Moroz et al.
3,860,122 A 1/1975 Cernosek
3,986,619 A 10/1976 Woolslayer et al.
4,172,684 A 10/1979 Jenkins
4,221,269 A * 9/1980 Hudson ..... 173/222
4,303,270 A 12/1981 Adair
4,403,666 A 9/1983 Willis
4,403,897 A 9/1983 Willis
4,407,629 A * 10/1983 Willis ..... 414/745.2
4,492,501 A 1/1985 Haney
4,595,066 A 6/1986 Nelmark et al.
4,650,237 A 3/1987 Lessway
4,708,581 A 11/1987 Adair
4,759,414 A 7/1988 Willis
4,822,230 A 4/1989 Slettedal
4,834,604 A 5/1989 Brittain et al.
4,843,945 A * 7/1989 Dinsdale ..... 81/57.34
5,458,454 A 10/1995 Sorokan
5,609,226 A 3/1997 Penisson (Continued)

OTHER PUBLICATIONS

U.S. Appl. No. 11/923,451, filed Oct. 24, 2007; non-published; titled "Pipe Handling Apparatus and Method" and having common inventors with the present patent application.

(Continued)

*Primary Examiner* — Cathleen Hutchins
(74) *Attorney, Agent, or Firm* — John G. Fischer, Esq.; Paul D. Lein, Esq.; Scheef & Stone, L.L.P.

(57) ABSTRACT

An apparatus for connecting or disconnecting a threaded connection of a first tubular member and a second tubular member at a wellhead has a frame movable between a first position adjacent the wellhead and a second position away from the wellhead, a first gripping member connected to the frame and extending outwardly therefrom so as to apply a torque to the first tubular, and a second gripping member movably connected to the frame so as to be movable between a first position away from the wellhead and a second position at the wellhead. The second gripping member is suitable for applying an opposing torque to the second tubular.

19 Claims, 7 Drawing Sheets

U.S. PATENT DOCUMENTS

| | | | | |
|---|---|---|---|---|
| 5,660,087 | A | 8/1997 | Rae | |
| 5,848,647 | A | 12/1998 | Webre et al. | |
| 5,992,801 | A | 11/1999 | Torres | |
| 5,993,140 | A | 11/1999 | Crippa | |
| 6,220,807 | B1 | 4/2001 | Sorokan | |
| 6,253,845 | B1 | 7/2001 | Belik | |
| 6,543,551 | B1 | 4/2003 | Sparks et al. | |
| 6,543,555 | B2 | 4/2003 | Casagrande | |
| 6,609,573 | B1 | 8/2003 | Day | |
| 6,705,414 | B2 | 3/2004 | Simpson et al. | |
| 6,779,614 | B2 | 8/2004 | Oser | |
| 6,845,814 | B2 | 1/2005 | Mason et al. | |
| 7,028,585 | B2 | 4/2006 | Pietras et al. | |
| 7,055,594 | B1 | 6/2006 | Springett et al. | |
| 7,090,035 | B2 | 8/2006 | Lesko | |
| 7,121,166 | B2 * | 10/2006 | Drzewiecki | 81/57.33 |
| 7,249,639 | B2 * | 7/2007 | Belik | 175/162 |
| 7,438,127 | B2 | 10/2008 | Lesko | |

OTHER PUBLICATIONS

U.S. Appl. No. 12/111,907, filed Apr. 29, 2008; non-published; titled "Pipe Gripping Apparatus" and having common inventors with the present patent application.

* cited by examiner

APPARATUS FOR PIPE TONG AND SPINNER DEPLOYMENT

CROSS-REFERENCE TO RELATED U.S. APPLICATIONS

The present application claims priority from U.S. Provisional Patent Application No. 61/138,396, filed by the present applicant on Dec. 17, 2008.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to apparatus for delivery of tubulars to and from a wellhead. Particularly, the present invention relates to apparatus for making and breaking a threaded connection between two tubulars. More particularly, the present invention relates to spinners and tongs of a tubular handling apparatus.

2. Description of Related Art

Including Information Disclosed Under 37 CFR 1.97 and 37 CFR 1.98.

Drill rigs utilize several methods for transferring tubular members from a pipe rack adjacent to the drill floor to a mousehole in the drill floor or the well bore for connection to a previously transferred tubular or tubular string. The term "tubular" as used herein includes all forms of pipe, drill pipe, drill collars, casing, liner, bottom hole assemblies (BHA), and other types of tubulars known in the art.

Conventionally, drill rigs utilize a combination of the rig cranes and the traveling system for transferring a tubular from the pipe rack to a vertical position above the center of the well. The obvious disadvantage with the prior art systems is that there is a significant manual involvement in attaching the pipe elevators to the tubular and moving the pipe from the drill rack to the rotary table at the wellhead. This manual transfer operation in the vicinity of workers is potentially dangerous and has caused numerous injuries in drilling operations. Further, the hoisting system may allow the tubular to come into contact with the catwalk or other portions of the rig as the tubular is transferred from the pipe rack to the drill floor. This can damage the tubular and may affect the integrity of the connections between successive tubulars in the well.

One method of transferring pipe from the rack to the well platform involves tying one end of a line on the rig around a selected pipe on the pipe rack. The pipe is thereafter lifted up onto the platform and the lower end thereof is placed into the mousehole. The mousehole is simply an upright, elongate cylindrical container adjacent to the rotary table which supports the pipe temporarily. When it is necessary to add the pipe to the drill string, slips are secured about the drill string on the rotary table thereby supporting the same in the well bore. The pipe is disconnected from the traveling equipment, and the elevators, or the kelly, are connected to the pipe in the mousehole. Next, the traveling block is raised by positioning the pipe over the drill string. Tongs are used to secure the pipe to the upper end of the drill string. The drill pipe elevators suspend the drill pipe from a collar, which is formed around one end of the pipe and does not clamp the pipe, thereby permitting rotational pipe movement in order to threadably engage the same to the drill string.

A prior art technique for moving joints of casing from racks adjacent to the drilling rig involves tying a line from the rig onto one end of a selected casing joint on the rack. The line is raised by lifting the casing joint up a ramp leading to the rig platform. As the rope lifts the casing from the rack, the lower end of the casing swings across the platform in a dangerous manner. The danger increases when a floating system is used in connection with drilling. Because the rope is tied around the casing at one end thereof, the casing does not hang vertically, but rather tilts somewhat. A man working on a platform elevated above the rig floor must hold the top of the casing and straighten it out while the casing is threaded into the casing string which is suspended in the well bore by slips positioned on the rotary table.

It is desirable to be able to grip casing or pipe positioned on a rack adjacent a drilling well, move the same into vertical orientation over the well bore, and thereafter lower the same onto the string suspended in the well bore.

In the past, various devices have been created which mechanically move a pipe from a horizontal orientation to a vertical orientation such that the vertically-oriented pipe can be installed into the well bore. Typically, these devices utilize several interconnected arms that are associated with a boom. In order to move the pipe, a succession of individual movements of the levers, arms, and other components of the boom must be performed in a coordinated manner in order to achieve the desired result. Typically, a wide variety of hydraulic actuators are connected to each of the components so as to carry out the prescribed movement. A complex control mechanism is connected to each of these actuators so as to achieve the desired movement. Advanced programming is required of the controller in order to properly coordinate the movements in order to achieve this desired result. Unfortunately, with such systems, the hydraulic actuators, along with other components, can become worn with time. Furthermore, the hydraulic integrity of each of the actuators can become compromised over time. As such, small variations in each of the actuators can occur. These variations, as they occur, can make the complex mechanism rather inaccurate. The failure of one hydraulic component can exacerbate the problems associated with the alignment of the pipe in a vertical orientation. Adjustments of the programming are often necessary so as to continue to achieve the desired results. Fundamentally, the more hydraulic actuators that are incorporated into such a system, the more likely it is to have errors, inaccuracies, and deviations in the desired delivery profile of the tubular. Typically, very experienced and knowledgeable operators are required so as to carry out this pipe movement operation. This adds significantly to the cost associated with pipe delivery.

In the past, pipe handling apparatus have not been used for the installation of casing. The problem associated with casing is that the threads of the casing are formed on an inner wall and on an outer wall at the ends of each of the casing sections. Whenever these threads are formed, the relatively thin wall thickness of the casing is further minimized. Additionally, great precision is required so as to properly thread the threads of one casing section within the threads of an adjacent casing section. The amount of accuracy required for the delivery of the casing by a pipe handling apparatus, in the past, has not been sufficient so as to achieve the desired degree of accuracy for the installation of the casing sections in their threaded connection. The improper installation of one casing section upon another casing section can potentially damage the threads associated with such casing sections. Additionally, in the past, the pipe handling apparatus could potentially damage the thin-walled casing sections during the delivery. As such, a need has developed to adapt a pipe handling apparatus so as to achieve the desired amount of accuracy for the installation of casing sections.

Various patents and patent applications relate to tubular handling apparatus. For example, U.S. application Ser. No. 11/923,451, filed on Oct. 24, 2007, discloses a pipe handling apparatus that has a boom pivotally movable between a first position and a second position, a riser assembly pivotally connected to the boom, an arm pivotally connected at one end to the first portion of the riser assembly and extending outwardly therefrom, a gripper affixed to an opposite end of the arm suitable for gripping a diameter of the pipe, a link pivotally connected to the riser assembly and pivotable so as to move relative to the movement of the boom between the first and second positions, and a brace having one end pivotally connected to the boom and an opposite end pivotally connected to the arm between the ends of the arm. The riser assembly has a first portion extending outwardly at an obtuse angle with respect to the second portion. The gripper has a stab frame affixed to an end of the arm, and grippers affixed to the side of the stab frame opposite the arm.

U.S. Pat. No. 3,177,944, issued on Apr. 13, 1965 to R. N. Knights, discloses a racking mechanism for earth boring equipment that provides for horizontal storage of pipe lengths on one side of and clear of the derrick. This is achieved by means of a transport arm which is pivoted toward the base of the derrick for swing movement in a vertical plane. The outer end of the arm works between a substantially vertical position in which it can accept a pipe length from, or deliver a pipe length to, a station in the derrick, and a substantially horizontal portion in which the arm can deliver a pipe length to, or accept a pipe length from, a station associated with storage means on one side of the derrick.

U.S. Pat. No. 3,464,507, issued on Sep. 2, 1969 to E. L. Alexander et al., discloses a portable rotary pipe handling system. This system includes a mast pivotally mounted and movable between a reclining transport position to a desired position at the site drilling operations which may be at any angle up to vertical. The mast has guides for a traveling mechanism that includes a block movable up and down the mast through operation of cables reeved from the traveling block over crown block pulleys into a drawwork. A power drill drive is carried by the traveling block. An elevator for drill pipe is carried by an arm swingably mounted relative to the power unit. Power tongs, slips, and slip bushings are supported adjacent the lower end of the mast and adapted to have a drill pipe extend therethrough from a drive bushing connected to a power drive whereby the drill pipe is extended in the direction of the hole to be drilled.

U.S. Pat. No. 3,633,771, issued on Jan. 11, 1972 to Woolslayer et al., discloses an apparatus for moving drill pipe into and out of an oil well derrick. A stand of pipe is gripped by a strongback which is pivotally mounted to one end of a boom. The boom swings the strongback over the rotary table thereby vertically aligning the pipe stand with the drill string. When both adding pipe to and removing pipe from the drill string, all vertical movement of the pipe is accomplished by the elevator suspended from the traveling block.

U.S. Pat. No. 3,860,122, issued on Jan. 14, 1975 to L. C. Cernosek, discloses an apparatus for transferring a tubular member, such as a pipe, from a storage area to an oil well drilling platform. The positioning apparatus includes a pipe positioner mounted on a platform for moving the pipe to a release position whereby the pipe can be released to be lowered to a submerged position. A load means is operably attached or associated with the platform and positioning means in order to move the pipe in a stored position to a transfer position in which the pipe is transferred to the positioner. The positioner includes a tower having pivotally mounted thereon a pipe track with a plurality of pipe clamp assemblies which are adapted to receive a pipe length. The pipe track is pivotally movable by hydraulic power means or gear means between a transfer position in which pipe is moved into the plurality of clamp assemblies and the release position in which the pipe is released for movement to a submerged position.

U.S. Pat. No. 3,986,619, issued on Oct. 19, 1976 to Woolslayer et al., discloses a pipe handling apparatus for an oil well drilling derrick. In this apparatus the inner end of the boom is pivotally supported on a horizontal axis in front of a well. A clamping means is pivotally connected to the outer end of the boom on an axis parallel to the horizontal axis at one end. The clamping means allows the free end of the drill pipe to swing across the boom as the outer end of the boom is raised or lowered. A line is connected at one end with the traveling block that raises and lowers the elevators and at the other end to the boom so as to pass around sheaves.

U.S. Pat. No. 4,172,684, issued on Oct. 30, 1979 to C. Jenkins, discloses a floor level pipe handling apparatus which is mounted on the floor of an oil well derrick suitable structure. This apparatus includes a support that is rockable on an axis perpendicular to the centerline of a well being drilled. One end of an arm is pivotally mounted on the support on an axis transverse to the centerline of the well. The opposite end of the arm carries a pair of shoes having laterally opening pipe-receiving seats facing away from the arm. The free end of the arm can be swung toward and away from the well centerline and the arm support can be rocked to swing the arm laterally.

U.S. Pat. No. 4,403,666, issued on Sep. 13, 1983 to C. A. Willis, discloses self-centering tongs and a transfer arm for a drilling apparatus. The clamps of the transfer arm are resiliently mounted to the transfer arm so as to provide limited axial movement of the clamps and thereby of a clamped downhole tubular. A pair of automatic, self-centering, hydraulic tongs are provided for making up and breaking out threaded connections of tubulars.

U.S. Pat. No. 4,407,629, issued on Oct. 4, 1983 to C. A. Willis, discloses a lifting apparatus for downhole tubulars. This lifting apparatus includes two rotatably mounted clamps which are rotatable between a side-loading position so as to facilitate the loading and unloading in the horizontal position, and a central position, in which a clamped tubular is aligned with the drilling axis when the boom is in the vertical position. An automatic hydraulic sequencing circuit is provided to automatically rotate the clamps into the side-loading position whenever the boom is pivoted with a downhole tubular positioned in the clamp. In this position, the clamped tubular is aligned with a safety plate mounted on the boom to prevent a clamped tubular from slipping from the clamps.

U.S. Pat. No. 4,492,501, issued on Jan. 8, 1985 to Haney, discloses a platform positioning system for a drilling operation which includes a support structure and a transfer arm pivotally connected to the support structure to rotate about a first axis. This platform positioning system includes a platform which is pivotally connected to the support structure to rotate about a second axis, and rod which is mounted between the transfer arm and the platform. The position of the arm and platform axes and the length of the rod are selected such that the transfer arm automatically and progressively raises the platform to the raised position by means of the rod as the transfer arm moves to the raised position. The transfer arm automatically and progressively lowers the platform to the lowered position by means of the rod as the transfer arm moves to the lowered position.

U.S. Pat. No. 4,595,066, issued on Jun. 17, 1986 to Nelmark et al., discloses an apparatus for handling drill pipes and used in association with blast holes. This system allows a drill pipe to be more easily connected and disconnected to a drill string in a hole being drilled at an angle. A receptacle is formed at the lower end of the carrier that has hydraulically operated doors secured by a hydraulically operated lock. A gate near the upper end is pneumatically operated in response to the hydraulic operation of the receptacle lock.

U.S. Pat. No. 4,822,230, issued on Apr. 18, 1989 to P. Slettedal, discloses a pipe handling apparatus which is adapted for automated drilling operations. Drill pipes are manipulated between substantially horizontal and vertical positions. The apparatus is used with a top mounted drilling device which is rotatable about a substantially horizontal axis. The apparatus utilizes a strongback provided with clamps to hold and manipulate pipes. The strongback is rotatably connected to the same axis as the drilling device. The strongback moves up or down with the drilling device. A brace unit is attached to the strongback to be rotatable about a second axis.

U.S. Pat. No. 4,834,604, issued on May 30, 1989 to Brittain et al., discloses a pipe moving apparatus and method for moving casing or pipe from a horizontal position adjacent a well to a vertical position over the well bore. The machine includes a boom movable between a lowered position and a raised position by a hydraulic ram. A strongback grips the pipe and holds the same until the pipe is vertically positioned. Thereafter, a hydraulic ram on the strongback is actuated thereby lowering the pipe or casing onto the string suspended in the well bore and the additional pipe or casing joint is threaded thereto.

U.S. Pat. No. 4,708,581, issued on Nov. 24, 1987 to H. L. Adair, discloses a method for positioning a transfer arm for the movement of drill pipe. A drilling mast and a transfer arm are mounted at a first axis adjacent the mast to move between a lowered position near ground level and an upper position aligned with the mast. A reaction point anchor is fixed with respect to the drilling mast and spaced from the first axis. A fixed length link is pivotally mounted to the transfer arm at a second axis, spaced from the first axis, and a first single stage cylinder is pivotally mounted at one end to the distal end of the link and at the other end to the transfer arm. A second single stage hydraulic cylinder is pivotally mounted at one end to the distal end of the link and at the other end to the reaction point.

U.S. Pat. No. 4,759,414, issued on Jul. 26, 1988 to C. A. Willis, discloses a drilling machine which includes a drilling superstructure skid which defines two spaced-apart parallel skid runners and a platform. The platform supports a drawworks mounted on a drawworks skid and a pipe boom is mounted on a pipe boom skid sized to fit between the skid runners of the drilling substructure skid. The drilling substructure skid supports four legs which, in turn, support a drilling platform on which is mounted a lower mast section. The pipe boom skid mounts a pipe boom as well as a boom linkage, a motor, and a hydraulic pump adapted to power the pipe boom linkage. Mechanical position locks hold the upper skid in relative position over the lower skid.

U.S. Pat. No. 5,458,454, issued on Oct. 17, 1995 to R. S. Sorokan, discloses a pipe handling method which is used to move tubulars used from a horizontal position on a pipe rack adjacent the well bore to a vertical position over the wall center. This method utilizes bicep and forearm assemblies and a gripper head for attachment to the tubular. The path of the tubular being moved is close to the conventional path of the tubular utilizing known cable transfer techniques so as to allow access to the drill floor through the V-door of the drill rig. U.S. Pat. No. 6,220,807 describes apparatus for carrying out the method of U.S. Pat. No. 5,458,454.

U.S. Pat. No. 6,609,573, issued on Aug. 26, 2003 to H. W. F. Day, discloses a pipe handling system for an offshore structure. The pipe handling system transfers the pipes from a horizontal pipe rack adjacent to the drill floor to a vertical orientation in a set-back area of the drill floor where the drill string is made up for lowering downhole. The cantilevered drill floor is utilized with the pipe handling system so as to save platform space.

U.S. Pat. No. 6,705,414, issued on Mar. 16, 2004 to Simpson et al., discloses a tubular transfer system for moving pipe between a substantially horizontal position on the catwalk and a substantially vertical position at the rig floor entry. Bundles of individual tubulars are moved to a process area where a stand make-up/break-out machine makes up the tubular stands. The bucking machine aligns and stabs the connections and makes up the connection to the correct torque. The tubular stand is then transferred from the machine to a stand storage area. A trolley is moved into position over the pick-up area to retrieve the stands. The stands are clamped to the trolley and the trolley is moved from a substantially horizontal position to a substantially vertical position at the rig floor entry. A vertical pipe-racking machine transfers the stands to the traveling equipment. The traveling equipment makes up the stand connection and the stand is run into the hole.

U.S. Pat. No. 6,779,614, issued on Aug. 24, 2004 to M. S. Oser, discloses a system and method for transferring pipe. A pipe shuttle is used for moving a pipe joint into a first position and then lifting upwardly toward an upper second position. In well-drilling and well-completion operations, it is necessary to lift and properly align lengths of downhole tubulars. For example, in oil or water well drilling, multiple lengths of drill pipe must often be raised from a horizontal position at or near ground level to a vertical position aligned with the centerline of the well. Such lifting and aligning operations require clamps for securely holding the pipe in place as it is lifted. When a pivotally mounted pipe boom is used, this boom must support large loads in several different orientations.

Compounding this problem is the fact that each joint of a length of a downhole tubular must be closely aligned with a string of such tubulars after it has been lifted to the vertical position, such as when a drill pipe or casing is made up. A clamp, or gripper, for this purpose should preferably provide a necessary alignment for downhole tubulars having various diameters, without any adjustment. Proper alignment has been a problem with many such clamps, or grippers, of the prior art, especially those employing pivoted clamping jaws. When pivoted clamping jaws are used, there is a tendency for the center of the downhole tubular to vary as a function of the diameter of the tubular being clamped.

Various patents and patent applications relate to grippers of tubular handling apparatus. For example, U.S. patent application Ser. No. 12/111,907, filed on Apr. 29, 2008 by the present inventor, discloses a pipe gripping apparatus having a first jaw with a pipe-contacting surface at one end thereof, a second jaw having a pipe-contacting surface at one end thereof, a tongue having a pipe-contacting surface at one end thereof, and an actuator connected to the first and second jaws and to the tongue. The actuator serves to move the first and second jaws and the tongue such that the pipe-contacting surfaces thereof move radially inwardly simultaneously for a substantially identical distance. A first link pivotally connects the tongue with the first jaw. A second link pivotally connects the tongue with the second jaw. The first and second links extend angularly outwardly from the tongue. The first and second pivot points of each jaw have a distance unequal to a distance between the first pivot point and pipe-contacting surface of each jaw. The pipe-contacting surfaces can be elastomeric pads, toothed dies, or rollers.

U.S. Pat. No. 3,280,920 issued on Oct. 25, 1966 to P. Scott, teaches a portable apparatus for drilling downhole wells. This apparatus has a mast having an open side and a means for supporting a string of drill pipes rotated within the mast. A means for raising and lowering a string of drill pipes in a rectilinear direction parallel to the longitudinal centerline of the mast is provided. This apparatus includes a hydraulic cylinder connected through a suitable arrangement of lines and sheaves so as to apply positive force upon the power swivel so as to move the swivel upwardly or downwardly in the mast as desired. This swivel is mounted on a wheeled carriage which runs on suitable tracks carried by the mast. An elongate frame is pivotably attached to the lower end of the mast for swinging movement to an open side of the mast between a substantially horizontal position and an upright position. Releasable clamps are adapted to grip a section of drill pipe mounted on the frame for a limited longitudinal reciprocating motion thereon.

U.S. Pat. No. 3,365,762, issued on Jan. 30, 1968 to W. H. Spiri, discloses a well pipe gripping structure having a slip body having a pipe gripping insert which is slidably movable horizontally into an arcuate guideway in the slip body. The slip body is retained within the guideway by upper and lower lips on the body. The lips have asymmetric retaining surfaces. The inserts are provided with teeth which advance vertically as the teeth advance circularly. The teeth of one insert are positioned out of alignment with the teeth of the other insert to increase the resistance to rotation of the pipe within the slip structure.

U.S. Pat. No. 3,561,811, issued on Feb. 9, 1971 to J. W. Turner, Jr., discloses a well drilling rig having a pipe racker apparatus in which a number of racker arms are controllable from a remote location to engage drill pipe tool joints and drill collars. One of the arms has a head for supporting the weight of lengths of pipe or drill collars being added to or removed from the drill string.

U.S. Pat. No. 3,702,640, issued on Nov. 14, 1972 to Cintract et al., shows a tipping girder with a transfer of tubular elements. This tipping girder has a plurality of adjustable guide nippers movably positioned on the girder for movement transverse to the longitudinal axis thereof. There are adjustable locking nippers movably mounted on the girder for movement parallel to and transverse to the longitudinal axis thereof. The locking nippers are constructed to automatically engage and lock a rod on the girder when it is moved away from the horizontal position.

U.S. Pat. No. 3,806,021, issued on Apr. 23, 1974 to Moroz et al., discloses a pipe centering apparatus. This apparatus has a carriage with a column mounted thereon to support a pipe end jointing mechanism. The carriage has a receptacle together with the column. The column pivotally supports a cantilever member of which the free extremity pivotably supports the pipe end jointing mechanism including coaxially arranged grippers adapted to retain the ends of the pipe.

U.S. Pat. No. 4,303,270, issued on Dec. 1, 1981 to H. L. Adair, discloses a self-centering clamp for downhole tubulars. This clamp includes first and second opposed clamping members guided along a clamping axis by first and second guide channels defined by a frame. Each clamping member defines a hydraulic cylinder in which is disposed a piston which is rigidly mounted to the frame. A rack is coupled to move with each of the clamping members. These racks are interconnected via a pinion gear which meshes with both racks so that the two clamping members move in a counter-directional manner and remain equidistant from a central point on the clamping axis.

U.S. Pat. No. 4,403,897, issued on Sep. 13, 1983 to C.A. Willis, discloses a self-centering clamp for drilling tubulars. This self-centering clamp includes first and second transverse guide rods. Two opposed clamping jaws are guided along the first guide rod. These jaws are positioned by two opposed rocker arms, each of which is mounted to a cross brace which slides along the second guide rod. The rocker arms are symmetrically positioned by a link mechanism which also slides along the second guide rod and by a hydraulic cylinder coupled between the two rocker arms. The frame is pivotably mounted to a pipe boom so as to rotate about an axis parallel to the clamped pipe and transverse to the first and second guide rods.

U.S. Pat. No. 4,650,237 issued on Mar. 17, 1987 to R. J. Lessway, discloses an automatic centering and gripping apparatus which includes a housing in which is slidably mounted a longitudinal movable operator body. A pair of gripper arms are slidably mounted on the operator body. Each gripper arm carries a gripper member engageable with a workpiece. The gripper members are moved longitudinally and laterally into gripping engagement with a workpiece when the operator body is moved in one longitudinal direction. They are correspondingly disengaged from the workpiece when the operator body is moved in the other longitudinal direction.

U.S. Pat. No. 5,609,226 issued on Mar. 11, 1997 to D. J. Penisson, discloses a slip-type gripping assembly having an outer body defining a longitudinal through opening for receipt of the object. A number of slip bodies are circumferentially spaced about the through opening and are radially movable toward and away from the locus of the object. Each slip body is pivotable about a generally longitudinal axis and generally circumferentially centered with respect to the slip body as well as about a tangential axis. A respective force transfer formation is cooperative between each slip body and the outer body for transferring radial force therebetween while permitting the pivoting.

U.S. Pat. No. 5,848,647, issued on Dec. 15, 1998 to Webre et al., discloses a pipe gripping apparatus for angularly adapting two misaligned pipes on one or more pipe strings. The apparatus has a housing having internal, opposing downwardly-curved surfaces therein and forming a longitudinal opening for passing a portion of at least one tubing string therethrough. A plurality of slip carriers each has an exterior surface contoured to match the downwardly curved surface and has a downwardly inclined interior surface. Each slip carrier is in movable connection with one of the curved surfaces of the housing. A plurality of slips has downwardly-inclined exterior surfaces and longitudinal channels formed on an internal surface for holding gripping elements for gripping a portion of the pipe.

U.S. Pat. No. 5,992,801, issued on Nov. 30, 1999 to C. A. Torres, discloses a pipe gripping assembly and method. This pipe gripping assembly has a primary pipe gripping mechanism and a backup, secondary pipe gripping mechanism carried in a single tapered slip bowl. The primary gripping mechanism employs smooth surface pipe dies that set against and grip and hold the pipe without damaging the pipe surface. After the primary mechanism is set, toothed dies in the secondary gripping mechanism are automatically engaged with the pipe with only a minimal pipe gripping force. Additional slippage of the pipe through the smooth dies sets the toothed dies down against a wedging surface to grip and hold the pipe to stop its downward movement. A resilient biasing device is used to urge the toothed dies away from the pipe before the smooth dies are set.

U.S. Pat. No. 5,993,140, issued on Nov. 30, 1999 to A. Crippa, discloses an apparatus for loading pipes onto processing machines. This apparatus has a handler arm with a first segment and a second segment disposed in succession. Kinematic members are adapted to determine a fixed ratio between the rotation angles of the segments about the respective hinging axes.

U.S. Pat. No. 6,543,551, issued Apr. 8, 2003 to Sparks et al., discloses an automatic pipe handling device which includes a support frame mounted on a boring device. Removable pipe racks can be placed in position on the support frame to deliver pipe to the spindle axis or to remove pipe therefrom as required. The pipe sections are removed from the pipe rack and positioned on the spindle axis by pipe grippers mounted on hydraulic cylinders mounted on a rotating longitudinal shaft. The grippers and shaft simultaneously return the used pipe sections for storage to the pipe rack.

U.S. Pat. No. 6,543,555, issued on Apr. 8, 2003 to M. Casagrande, discloses an automatic loader for drill rods adapted to be used in association with a boring machine. The automatic motor has a store containing a plurality of drill rods and a movement assembly that is able to selectively remove, one at a time, the drill rods from the store to position them on the guide and drive assembly. The movement assembly is arranged in an intermediate position between the store and the guide and drive assembly so as to not interfere with the latter during the removal of the drill rods from the store.

U.S. Pat. No. 6,845,814, issued on Jan. 25, 2005 to Mason et al., discloses a pipe-gripping structure having load rings. In particular, a rotary slip supports a drill string having a plurality of slip segments connected to define an opening for insertion of the drill string. Each slip segment has a head region, a toe region, and an inner radial surface axially extending between the head and toe regions. The inner radial surface of each slip segment has a circumferential groove. A plurality of axially aligned drill string gripping inserts are attached to each slip segment between the head region and the circumferential groove. Each insert has a gripping surface for contacting the drill string.

U.S. Pat. No. 7,055,594, issued on Jun. 6, 2006 to Springett et al., discloses a pipe gripper and top drive system in which the pipe gripping system is located beneath the top drive unit. The pipe gripping system has an open throat for receiving a tubular to be gripped by the pipe gripping system. The gripping system has a body with first and second jaws movably connected thereto and a piston/cylinder assembly movably interconnected with each jaw for moving the jaws to clamp and then to rotate the pipe.

U.S. Pat. No. 7,090,035, issued on Aug. 15, 2006 to G. Lesko, discloses a method and system for connecting pipe to a top drive motor. This system includes a top drive motor that tilts about a horizontal axis and a pipe launcher that brings joints of pipe up to the drilling platform for connection with a top drive motor at a safe and convenient height above the platform. The top drive motor further includes a clamping assembly that grasps and pulls the joint of the pipe to the motor as the connection is being made. The clamp assembly supports the motor-pipe connection as the top-drive top drive motor is raised in the drilling mast of the rig bringing the joint of pipe up into a vertical orientation for connection with the drill tubing string.

U.S. Pat. No. 7,121,166 B2, issued on Oct. 17, 2006 to Drzewiecki, discloses a tong assembly that has a body and a center member slidable relative to the body. A pair of clamping arms are rotatably connected to the body. The clamping arms are connected to the center member such that as the center member slides relative to said body, the clamping arms rotate relative to the body. The assembly also has die assemblies, wherein at least one die assembly is mounted to each clamping arm and at least one die assembly is mounted to the center member.

A problem associated with tubular handling apparatus is that tubulars delivered by the apparatus to the wellhead must be connected and disconnected from a string of tubulars extending within the well bore. Special equipment is used to make or break the threaded connections between tubular; however, this equipment is usually heavy, expensive and is usually used with an oil derrick.

Another problem is that typical oil wells have an oil derrick or mast centered over the wellhead. An oil derrick is a specific type of derrick that is used over oil and gas wells and other drilled holes. The oil derrick is used to position tubulars over the wellhead for insertion and removal therefrom. Oil derricks are typically structures of a steel framework that are immobile.

Another problem is that typical oil derricks have a number of complex machines designed specifically to perform a specific function for delivering and removing tubulars to and from the wellhead, in addition to having machinery for drilling the well and producing the oil and/or gas. An oil derrick can also control the weight of the drill bit. Each type of drill bit has an optimum pressure at which it should be pushed through the earth for drilling a well. An oil derrick can be used to control this pressure. An oil derrick can include a boom so as to deliver equipment to and from the wellhead using the structure of the oil derrick as support. Oil derricks are most advantageous for oil wells that have a long life expectancy for producing oil. However, large deposits of oil are becoming increasingly rare, and permanent oil derricks of the past are sometimes not suitable for modern oil wells.

Another problem is that typical oil derricks require a large number of experienced workers to operate the machines and equipment associated with the derrick. Workers commonly associated with oil derricks are geologists, engineers, mechanics, and safety inspectors. Thus, there is a need for a way to make and break the threaded connections between tubulars at a wellhead without the use of an oil derrick.

Various patents have issued relating to tongs and spinners used to make and break threaded connections of tubulars. For example, U.S. Pat. No. 7,028,585, issued on Apr. 18, 2006 to Pietras et al., discloses an apparatus for applying torque to a first tubular relative to a second tubular that has a first tong for gripping the first tubular and a second tong for gripping the second tubular. The first tong has teeth around a peripheral surface thereof. The second tong has a pinion that meshes with the teeth of the first tong so that the first tong and the second tong rotate relative to one another when the pinion rotates. A positioning apparatus determines the position of the tubular relative to the tong. The positioning apparatus has a plunger movably disposed on a base and coupled to a visual indicator. The plunger has a contact member disposed at one end. The contact with the tubular causes the plunger to move along the base and the distance traveled is indicated by the visual indicator.

U.S. Pat. No. 6,253,845, issued on Jul. 3, 2001 to Belik, discloses a roller for use in a spinner apparatus for installing a pipe segment in a well pipe. The roller has a core member having a central aperture, and annular members arranged in stacked relation over the core member. The annular members are secured together. The core member has a generally tubular section having a first end and a second end, and a flange section extending radially outwardly of the tubular section between the first and second ends. The flange section has a greater diameter than the tubular section. The flange section has a plurality of holes formed therein. The annular members have a plurality of holes formed therein. The holes of the annular member are aligned with the holes of the flange section. Fasteners extend through the holes in the flange section and the hole of the annular members.

U.S. Pat. No. 5,660,087, issued on Aug. 26, 1997 to Rae, discloses drill pipe spinner that is suspended under a hanger and has upper and lower mounting plates. An air motor is supported on the upper mounting plate and extends a rotatable shaft through the mounting plate to rotate a driven sprocket. The air motor is cooperative with a gear box. Left and right rollers are rotated by the use of suitable sprockets. The spinner incorporates an air cylinder which has an extending piston rod. The rod actuates a bell crank which clamps the drill pipe.

U.S. Pat. No. 7,438,127, issued on Oct. 21, 2008 to Lesko, discloses a pipe-gripping clamp assembly for use on a top drive unit to grip sections of drilling pipe. The clamp assembly has a pair of hinged jaws that are opened and closed by a pair of rams attached to the jaws and to frame members. Each jaw has a jaw insert that is surfaced to firmly grip a pipe and can be easily replaced once worn beyond service. The rams are either hydraulically or pneumatically operated. Tongs are typically used to torque the connection between the two tubulars at a wellhead. The torque is applied to an upper tubular to either disconnect or connect the threaded connections between the two tubulars.

Typically, the tongs are located on the platform, or hung from a derrick on a chain. Two tongs are typically used to make and break the threaded connections between the tubulars. A make-up tong supplies torque to the tubular above the threaded connection, and the back-up tong supplies a reaction torque below the threaded connection of the tubulars. The back-up tong typically clamps the lower tubular below the threaded connection so as to prevent the lower tubular from rotating. The make-up tong rotates the upper relative to the lower tubular so as to either disconnect or connect the threaded connection of the tubulars. Tongs are similar to grippers except that tongs can rotate the tubular while grippers simply grip the tubular in a stationary position. Spinners are also like grippers, except that surfaces of the spinner that contact the tubular are movable so that the tubular can spin and rotate freely within the spinner while the spinner holds the tubular in position.

It is an object of the present invention to connect and disconnect the threaded connection of tubulars at a wellhead.

It is another object of the present invention to keep the tubulars aligned while disconnecting and connecting the threaded connections.

It is another object of the present invention to provide an apparatus that avoids the use of a derrick while making and breaking threaded connections of tubulars.

It is another object of the present invention to provide an apparatus that simultaneously holds one tubular while rotating another tubular.

It is another object of the present invention to provide an apparatus that allows relatively unskilled workers to connect and disconnect threaded connections between tubulars.

It is still another object of the present invention to provide an apparatus that can grip different diameters of tubulars.

It is another object of the present invention to avoid elastic and plastic deformation of a tubular while disconnecting and connecting the threaded connections of tubulars.

It is another object of the present invention to distribute a contact pressure of the tongs and spinners over the surface of the tubular.

These and other objects and advantages of the present invention will become apparent from a reading of the attached specification and appended claims.

BRIEF SUMMARY OF THE INVENTION

The present invention is an apparatus for connecting or disconnecting a threaded connection of a first tubular member and a second tubular member at a wellhead. The apparatus comprises a frame movable between a first position adjacent the wellhead and a second position away from the wellhead, a first gripping member connected to the frame and extending outwardly therefrom so as to apply a torque to the first tubular, and a second gripping member movably connected to the frame so as to be movable between a first position away from the wellhead and a second position at the wellhead. The second gripping member is suitable for applying a torque to the second tubular. The first gripping member applies torque to the first tubular in a direction opposite to the torque applied to the second tubular by the second gripping member.

In the present invention, the first gripping member is positioned directly above the second gripping member when the second gripping member is in the second position. A spinner can be connected to the frame and extends outwardly therefrom. The spinner is suitable for rotating the first tubular member. The frame has a first side and a second side opposite the first side. The second gripping member extends outwardly of the first side in the second position. The second gripping member is at the second side in the first position. The second gripping member of the present invention includes a gripper, an arm connected to a backside of the gripper, and a means for moving the arm between the first position and the second position. The arm is pivotally connected to the frame.

The spinner has a first spinner surface and a second spinner surface thereon. The spinner has a first motor positioned above the first jaw thereof. The spinner has a second motor positioned above a second jaw thereof. The first motor is mechanically connected to the first spinner surface. The second motor is mechanically connected to the second spinner surface.

Each of the first and second gripper members includes a first jaw having a tubular-contacting surface, a second jaw having a tubular-contacting surface, a drive yoke having a tubular-contacting surface at an end thereof, and an actuator connected to the drive yoke. The drive yoke is connected to the first jaw and to the second jaw. The actuator moves the first jaw and the second jaw and the drive yoke such that the tubular-contacting surfaces thereof move radially inwardly for a substantially identical distance.

The present invention can also include a structural member with an arm connected thereto. The arm is extendable outwardly therefrom. The frame is connected to the arm opposite the structural member. The structural member is pivotable between a horizontal orientation and an upwardly extending orientation. The arm extends outwardly of the structural member when the structural member is in the upwardly extending position.

DETAILED DESCRIPTION OF THE INVENTION

Figure 1:
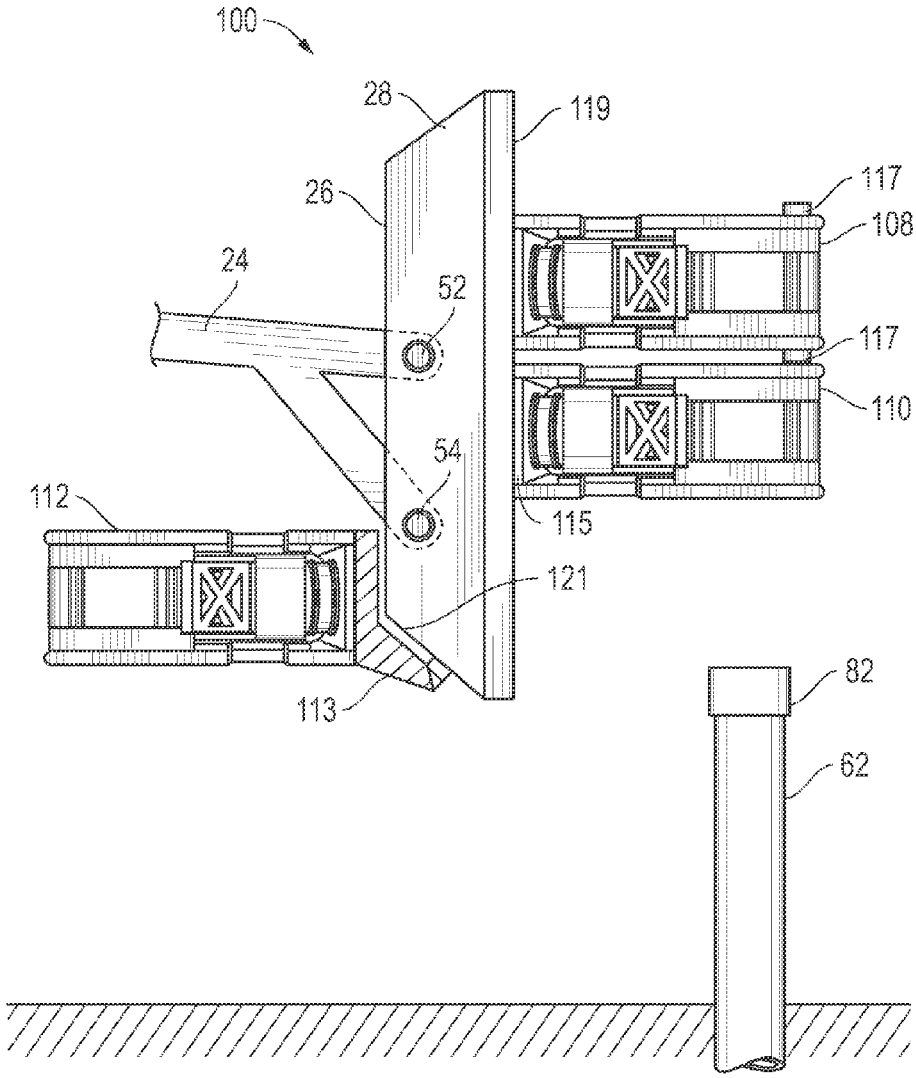
FIG. 1 shows a side elevational view of the apparatus of the present invention, with the back-up tong in the stored position.

Referring to FIG. 1, there is shown a side elevational view of the preferred embodiment of the apparatus 100 for pipe-tong and spinner deployment. The apparatus 100 has a stab frame 28. A spinner 108 is connected to a side 119 of the stab frame 28. The spinner 108 has motors 117 on the top and bottom thereof for turning spinner members, or rollers. A make-up tong 110 is connected to the side 119 of the stab frame 28 below the spinner 108. The make-up tong 110 has a rotating means 115 that allows the make-up tong 110 to rotate a tubular relative to tubular 62. The apparatus 100 is shown with a back-up tong 112 in a stored position. In the stored position, the back-up tong 112 is positioned adjacent another side 121 of the stab frame 28. A pivoting means 113 connects the back-up tong 112 to the stab frame 28. The pivoting means 113 pivots the back-up tong 112 relative to the stab frame 28 so as to position the back-up tong 112 under the box 82 of tubular 62. Box 82 of tubular 62 has a threaded connection with which tubular 62 connects to another tubular. The apparatus 100 is shown as connected to an arm 24 of a tubular handling system. The arm 24 is connected to the stab frame 28 at pin connections 52 and 54. The tubular handling system is discussed in more detail in FIGS. 3-5.

Figure 2:
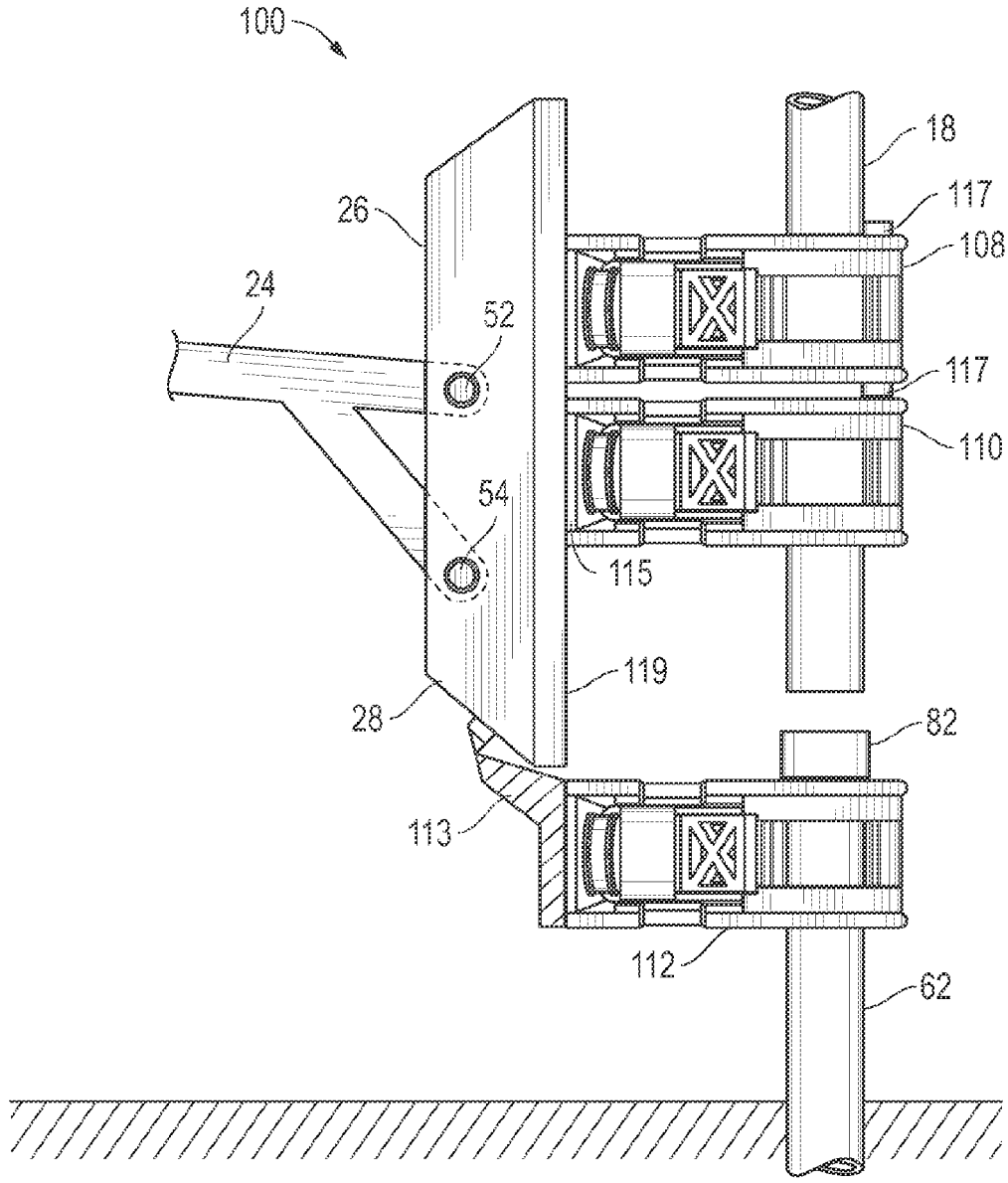
FIG. 2 shows a side elevational view of the apparatus of the present invention, with the back-up tong in the deployed position.

Referring to FIG. 2, there is shown a side elevational view of the preferred embodiment of the apparatus 100 of the present invention, with the back-up tong 112 in a deployed position. The spinner 108 and make-up tong 110 hold tubular 18 within the jaws thereof. The jaws of spinner 108 and jaws of make-up tong 110 are vertically aligned so as to vertically align the tubular 18 over the tubular 62. The back-up tong 112 holds tubular 62 so as to align the spinner 108 and make-up tong 110 over the box 82 of the tubular 62 so as to make or break a threaded connection between tubulars 18 and 62. The pivoting means 113 is specially designed according to the size of the stab frame 28 so as to enable the back-up tong 112 to pivot, through hinged connections or otherwise, relative to the stab frame 28 and reach the tubular 62 so as to bring the stab frame 28, spinner 108, and make-up tong 110 in alignment. When in the stored position, the jaws of the back-up tong 112 can be in an open position or a closed position, depending on various circumstances and how the back-up tong 112 is used. When the back-up tong 112 moves from the stored position to the deployed position, the jaws of the back-up tong 112 open so as to receive tubular 62 therein. As the pivoting means 113 rotates the back-up tong 112 toward the tubular 62, the tubular 62 slips within the jaws of the back-up tong 112. The jaws of the back-up tong 112 then move from the open position to the closed position so as to grasp and hold the tubular 62 therein. The back-up tong 112 firmly holds the tubular 62 so as to firmly set the position of the apparatus 100 relative to the tubular 62. Once the apparatus 100 is in proper position relative to the tubular 62, tubular 18 is rotated by the rotating means 115 of the make-up tong 110 so as to connect or disconnect the tubular 18 from tubular 62. The motors 117 connected to rollers of the spinner 108 help rotate the tubular 18 along its longitudinal axis. The rotating means 115 can be any sort of mechanism that helps the make-up tong 110 torque the tubular 18 so as to rotate the tubular 18 and either connect or disconnect the tubular 18 from the box 82 of tubular 62. The pivoting means 113 can be any mechanism that allows the back-up tong 112 to pivot relative to the stab frame 28. As used herein, the "pivoting means" can include a variety of mechanisms. In the simplest form, a pneumatic or hydraulic actuator can be connected to the stab frame 28 and to the arm extending to the back-up tong 112 so as to extend and retract the arm. Motors and associated gearing mechanisms can also be utilized to achieve the proper movement.

Figure 3:
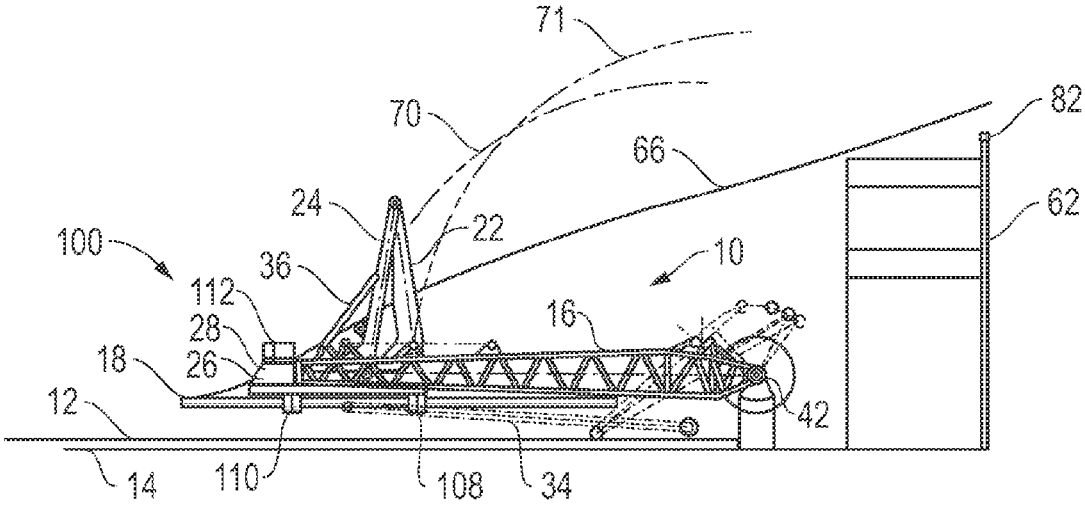
FIG. 3 shows a side elevational view of a tubular handling system in the first position, with the apparatus of the present invention attached thereto.

Referring to FIG. 3, there is shown a side elevational view of a tubular handling system 10 with the apparatus 100 of the present invention attached thereto. The tubular handling system 10 is in a first position. In the first position, the tubular 18 is in a horizontal orientation. The back-up tong 112 is in the stored position relative to the stab frame 28. The spinner 108 and the make-up tong 110 hold the tubular 18 in the horizontal position. The tubular handling system 10 moves from the first position to a second position, which is shown in FIGS. 3 and 4.

Figure 4:
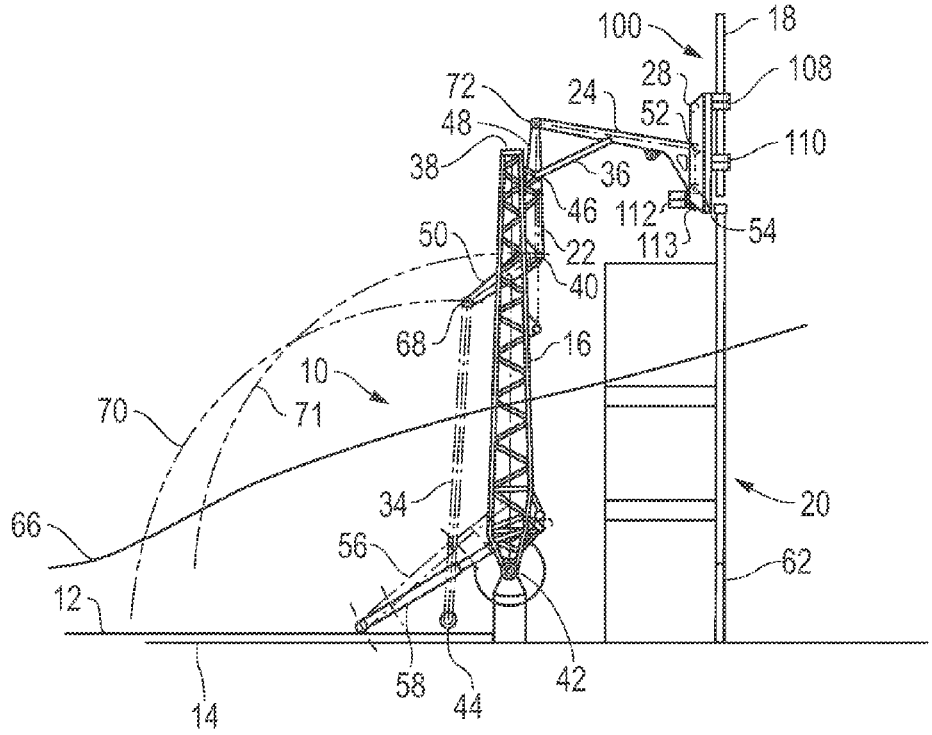
FIG. 4 shows a side elevational view of a tubular handling system in the second position, with the apparatus of the present invention attached thereto, and the back-up tong in the stored position.

Referring to FIG. 4, there is shown a side elevational view of the tubular handling system 10 in the second position, with the back-up tong 112 of the apparatus 100 of the present invention in the stored position. The tubular handling system 10 is mounted on a skid 12 that is supported upon the bed 14 of a vehicle, such as a truck. The tubular handling system 10 in particular includes a main rotating structural member 16 that is pivotally movable between a first position and a second position. In FIG. 4, the tubular 18 is illustrated in its position prior to installation on the drill rig 20. A lever assembly 22 is pivotally connected to the main rotating structural member 16. An arm 24 is pivotally connected to an end of the lever assembly 22 opposite the main rotating structural member 16. The stab frame 28 of the apparatus 100 is fixedly connected to an opposite end of the arm 24 opposite the lever assembly 22. The apparatus 100 has spinner 108, make-up tong 110, and back-up tong 112, as described above. A link 34 has one end pivotally connected to the skid 12 and an opposite end pivotally connected to the end of the lever assembly 22 opposite the arm 24. A brace 36 is pivotally connected to the main rotating structural member 16 and also pivotally connected to the arm 24 between the lever assembly 22 and the stab frame 28 of the apparatus 100. In the tubular handling system 10, the main rotating structural member 16 is a structural framework of struts, cross members and beams. In particular, in the tubular handling system 10, the main rotating structural member 16 is configured so as to have an open interior such that the tubular 18 will be able to be lifted in a manner so as to pass through the interior of the main rotating structural member 16. As such, the end 38 of the main rotating structural member 16 should be strongly reinforced so as to provide the necessary structural integrity to the main rotating structural member 16. A lug 40 extends outwardly from one side of the main rotating structural member 16. This lug 40 is suitable for pivotable connection to the lever assembly 22. The main rotating structural member 16 is pivotally connected at the opposite end 42 to a location on the skid 12. The pivotable connection at end 42 of the main rotating structural member 16 is located in offset relationship and above the pivotable connection 44 of the link 34 with the skid 12. A small frame member 46 extends outwardly from the side of the main rotating structural member 16 opposite the link 34. Small frame member 46 has a pivotable connection with the brace 36. The lever assembly 22 includes a first portion 48 and a second portion 50. The first portion 48 extends at an obtuse angle with respect to the second portion 50. The link 34 is pivotally connected to the end of the second portion 50 opposite the first portion 48. The arm 24 is pivotally connected to the end of the first portion 48 opposite the second portion 50. The lug 40 of the main rotating structural member 16 is pivotally connected in an area generally between the first portion 48 and the second portion 50. This unique arrangement of the lever assembly 22 facilitates the ability of the present invention to carry out the movement of the tubular 18 between the horizontal orientation and the vertical orientation.

The arm 24 has an end pivotally connected to the end of the first portion 48 of the lever assembly 22. The opposite end of the arm 24 is connected to the stab frame 28 of apparatus 100. In particular, a pair of pin connections engages a surface of the stab frame 28 of apparatus 100 so as to fixedly position the apparatus 100 with respect to the end of the arm 24. The pin connections 52 and 54 can be in the nature of bolts, or other fasteners, so as to strongly connect the stab frame 28 of the apparatus 100 with the arm 24. The bolts associated with pin connections 52 and 54 can be removed such that other stab frames of different sizes can be affixed to the end of the arm 24. As such, the tubular handling system 10 of the present invention can be adaptable to various sizes of tubular 18 and various heights of drilling rigs 20. The stab frame 28 of the apparatus 100 has a spinner 108, a make-up tong 110 positioned below the spinner 108, and a back-up tong 112. The spinner 108, the make-up tong 110, and the back-up tong 112 have jaws like conventional grippers which can open and close so as to engage the outer surface of the tubulars 18 and 62. When the tubular handling system 10 is in the second position, the tubular 18 is somewhat properly aligned over tubular 62 so as to threadedly connect or disconnect the two tubulars 18 and 62; however, actual use with the tubular handling system 10 found that a finer aligning mechanism was needed. Thus, the back-up tong 112 was added to the stab frame 28 so as to further properly align the stab frame 28, the spinner 108, the back-up tong 112, and thus the tubular 18 with the tubular 62. In FIG. 4, the back-up tong 112 is still in the stored position. The link 34 is an elongate member that extends from the pivotable connection 44 to the pivotable connection 68 of the second portion 50 of the lever assembly 22. The link 34 is non-extensible and extends generally adjacent to the opposite side from the main rotating structural member 16 from that of the arm 24. The link 34 will generally move relative to the movement of the main rotating structural member 16. The brace 36 is pivotally connected to the small frame member 46 associated with main rotating structural member 16 and also pivotally connected at a location along the arm 24 between the ends thereof. Brace 36 provides structural support to the arm 24 and also facilitates the desired movement of the arm 24 during the movement of the tubular 18 between the horizontal orientation and the vertical orientation. Actuators 56 and 58 are illustrated as having one end connected to the skid 12 and an opposite end connected to the main rotating structural member 16 in a location above the end 42. When the actuators 56 and 58 are activated, they will pivot the main rotating structural member 16 upwardly from the horizontal orientation ultimately to a position beyond vertical so as to cause the tubular 18 to achieve a vertical orientation. Within the concept of the present invention, a single hydraulic actuator can be utilized instead of the pair of hydraulic actuators 56 and 58, as illustrated in FIG. 4.

In FIG. 4, the general movement of the bottom end of the tubular 18 is illustrated by line 66. The movement of the pivot point 68 of the connection between the lever assembly 22 and the link 34 is illustrated by line 70. Curved line 71 illustrates the movement of the pivotable connection 40 between the main rotating structural member 16 and the lever assembly 22.

The coordinated movement of each of the non-extensible members of the system 10 is achieved with proper sizing and angular relationships. In essence, the present invention provides a four-bar link between the various components. As a result, the movement of the drill tubular 18 between a horizontal orientation and a vertical orientation can be achieved purely through the mechanics associated with the various components. As can be seen, only a single hydraulic actuator may be necessary so as to achieve this desired movement. There does not need to be coordinated movement of hydraulic actuators. The hydraulic actuators 56 and 58 are only used for the pivoting of the main rotating structural member. Since the skid 12 is located on the bed of a vehicle 14, the vehicle 14 can be maneuvered into place so as to properly align with the centerline of the drill pipe 62 of the drilling rig 20. Once the proper alignment is achieved by the vehicle 14, the system 10 can be operated so as to effectively move the tubular 18 to its desired position. The apparatus 100 of the present invention allows the drill tubular 18 to be moved upwardly and downwardly for the proper stabbing of the drill pipe 62. The present invention is adaptable to various links of tubular 18. Various types of stab frames 28 can be installed on the end of the arm 24 so as to properly accommodate longer lengths of tubular 18.

Instead of the complex control mechanisms that are required with prior art systems, the present invention achieves results by simple maneuvering of the vehicle 14, along with operation of the hydraulic cylinders 56 and 58. All other linkages and movement of the tubular 18 are achieved purely because of the mechanical connections between the various components. As such, the present invention assures a precise, self-centering of the tubular 18 with respect to the desired connecting pipe 62. This is accomplished with only a single degree of freedom in the tubular handling system 10.

Figure 5:
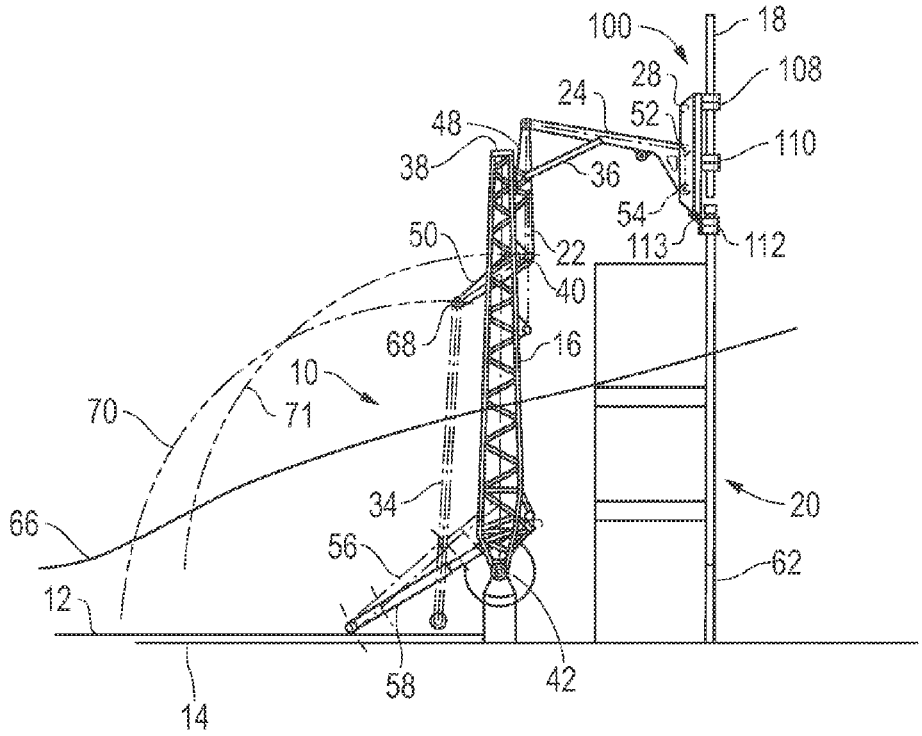
FIG. 5 shows a side elevational view of the tubular handling system in the second position, with the apparatus of the present invention attached thereto, and the back-up tong in the deployed position.

Referring to FIG. 5, there is shown a side elevational view of the tubular handling system 10 in the second position, with the back-up tong 112 in the deployed position. The back-up tong 112 is moved relative to the stab frame 28 of the apparatus 100 by the pivoting action provided by the pivoting means 113. The back-up tong 112 firmly grasps the tubular 62 at the wellhead so as to force the stab frame 28 into proper alignment with the tubular 62. The make-up tong 110 has provided a torque to the tubular 18 so as to break the threaded connection between the tubulars 62 and 18. The tubular 18 has been raised upwardly above the tubular 62. The spinner 108 provides alignment and holding stability of the tubular 18 while the make-up tong 110 rotates the tubular 18 relative to the tubular 62. The tongs 110 and 112, the spinner 108, and the stab frame 28 of the apparatus 100 of the present invention thus work together to connect and disconnect tubular 18 from tubular 62 at a wellhead.

Referring again to FIG. 3, the drill tubular 18 is in a generally horizontal orientation. It is important to note that the tubular 18 can be delivered to the tubular handling system 10 in a position below the main rotating structural member 16. In particular, the tubular 18 can be loaded upon the skid 12 in a location generally adjacent to the spinner 108, the make-up tong 110, and the back-up tong 112 associated with the stab frame 28. As such, the tubular handling system 10 facilitates the easy delivery of the tubular 18 to a desired location. The spinner 108 and the make-up tong 110 grip the outer surface of the tubular 18 in this horizontal orientation.

In FIG. 3, it can be seen that the main rotating structural member 16 resides above the tubular 18 and in generally parallel relationship to the top surface of the skid 12. The lever assembly 22 is suitably pivoted so that the arm 24 extends through the interior of the framework of the main rotating structural member 16 and such that the spinner 108 and make-up tong 110 on the stab frame 28 engage the tubular 18. The brace 36 resides in connection with the small frame member 46 of the main rotating structural member 16 and also is pivotally connected to the arm 24. The link 34 resides below the main rotating structural member 16 generally adjacent to the upper surface of the skid 12 and is connected to the lever assembly 22 below the main rotating structural member 16.

Figure 6:
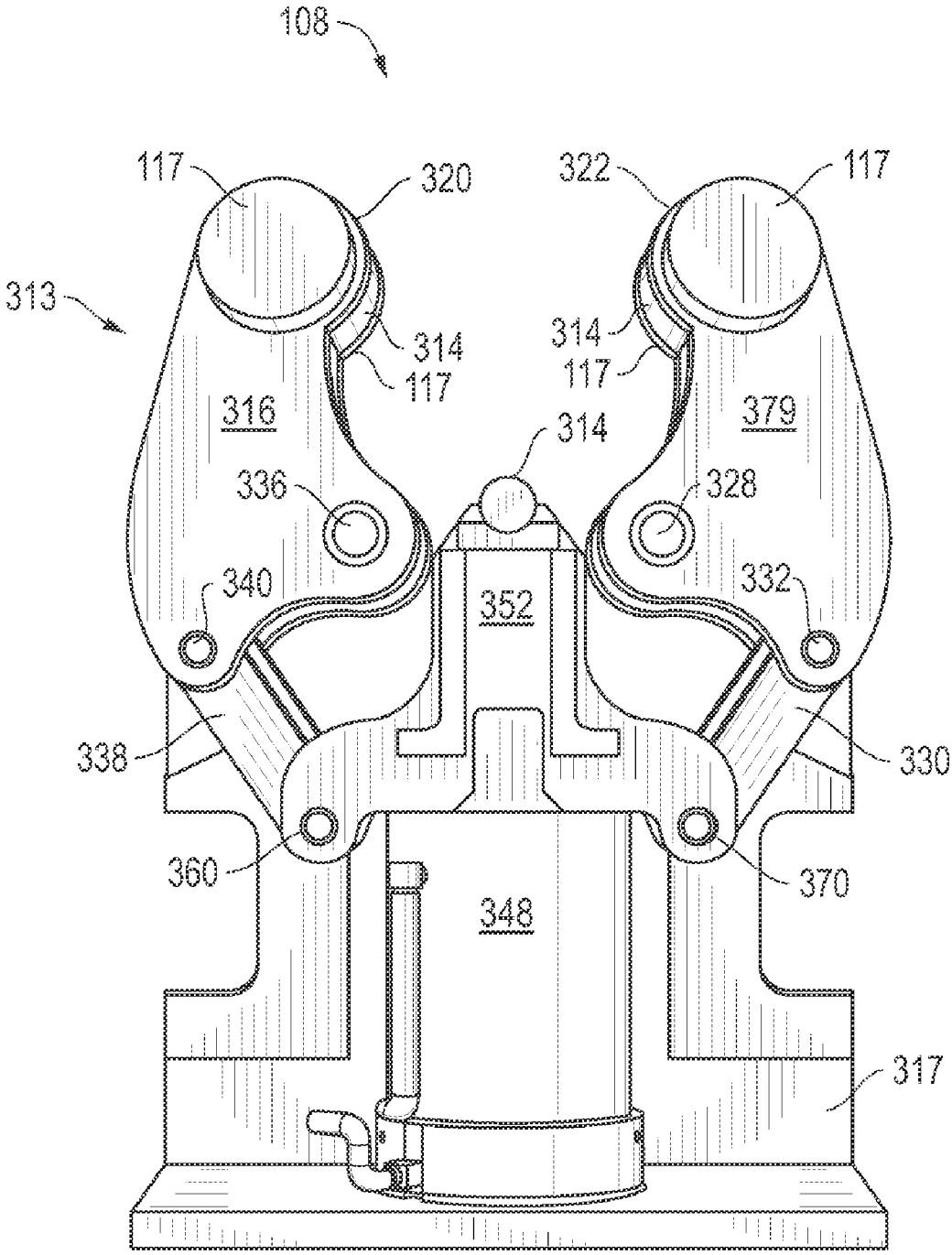
FIG. 6 shows a top perspective view of the spinner of the apparatus of the present invention.

Referring to FIG. 6, there is shown an isolated top perspective view of the spinner 108 of the apparatus 100 of the present invention. The spinner 108 has a jaw assembly 313. The jaw assembly consists of a first jaw 379 and a second jaw 316. The first jaw 379 and second jaw 316 are each connected to a drive yoke 352 by links 330 and 338, respectively. The link 330 connects to the first jaw 379 at first pivot point 332. The link 330 connects to the drive yoke 352 at second pivot point 370. The second link 338 connects to the second jaw 316 at first pivot point 340. The second link 338 connects to the drive yoke 352 at second pivot point 360. The drive yoke 352 is connected to an actuator means 348. In the preferred embodiment, the actuator means 348 is a piston-and-cylinder assembly. The actuator means 348 is positioned within housing 317. The first jaw 379 is connected to the housing 317 at pivot point 328. The second jaw 316 is connected to the housing 317 at pivot point 336. The jaw assembly 313 of the spinner 108 has tubular-contacting surfaces 314. The tubular-contacting surface 314 of the first jaw 379 is a spinner member 322, or roller. The tubular-contacting surface 314 of the second jaw 316 is a spinner member 320, or roller. The spinner members 322 and 320 can freely rotate along their longitudinal axes so as to allow a tubular held among the three tubular-contacting surfaces 314 to rotate within the jaw assembly 313. Motors 117 are positioned above and below the first jaw 379 so as to rotate the spinner member 322. Motors 117 are positioned above and below the second jaw 316 so as to rotate the spinner member 320. The actuator means 348 causes the drive yoke 352 to move forwards and backwards so as to cause the first and second jaws 379 and 316 to open and close around the outer surface of a tubular.

Figure 7:
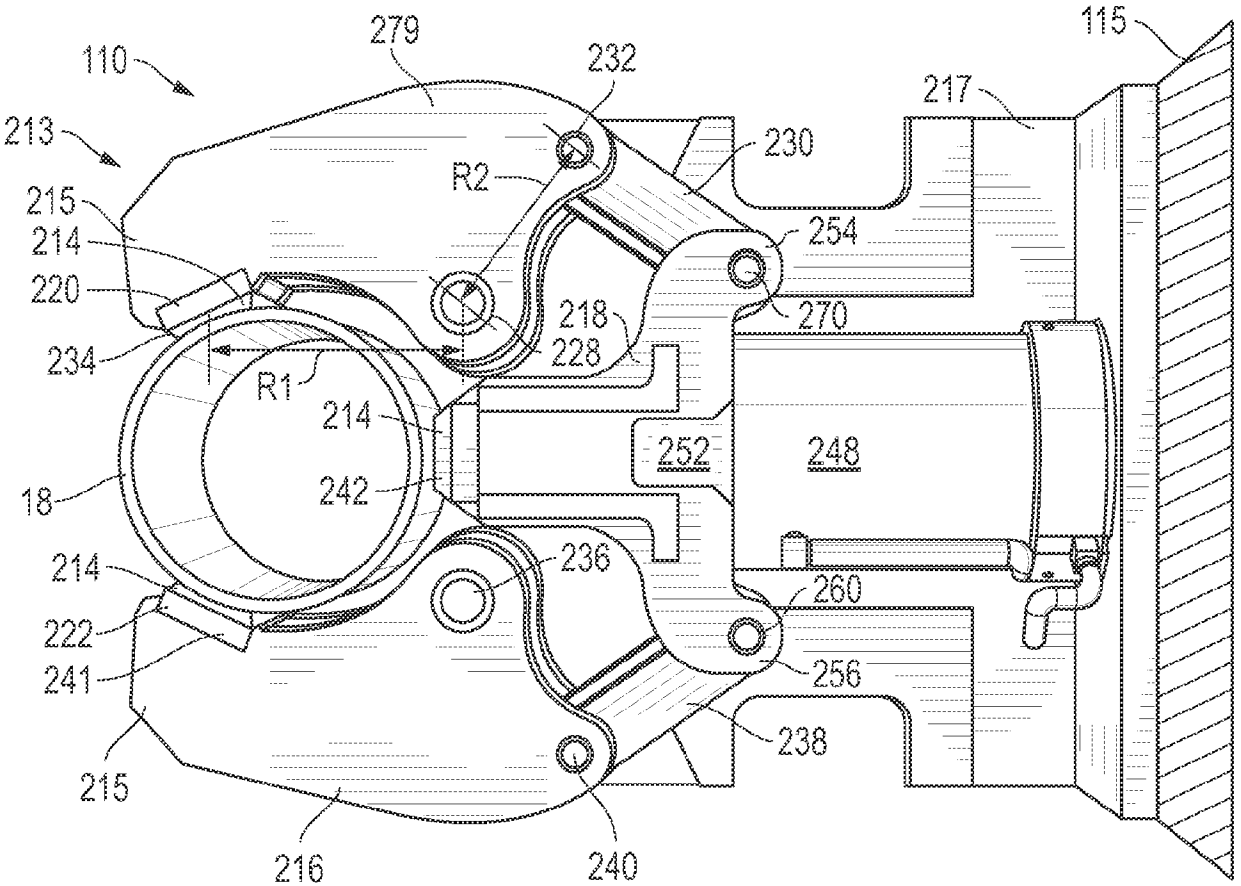
FIG. 7 shows a top perspective view of the make-up tong of the apparatus of the present invention.

Referring to FIG. 7, there is shown a top perspective view of the make-up tong 110 of the apparatus 100. The rotating means 115 can be seen as attached to the back of the housing 217 of the make-up tong 110. The rotating means 115 can be any suitable mechanism for rotating the jaw assembly 213 of the tong 110 so as to provide a torque on tubular 18.

The make-up tong 110 has a jaw assembly 213 positioned around the outer surface of the tubular 18. The jaw assembly 213 has tubular gripping surfaces 214 on the end 215 thereof. The tubular gripping surfaces 214 contact the tubular 18 when the make-up tong 110 is in the second position. The make-up tong 110 has a housing 217. The housing 217 covers the top, back, and bottom of the make-up tong 110. The jaw assembly 213 has a portion that moves within the housing 217. The unique configuration of the jaw assembly 213 allows the make-up tong 110 of the present invention to grip large and small diameters of tubulars without having to change the jaws of the jaw assembly 213. Thus, the make-up tong 110 of the present invention eliminates the need for additional adapters and thus removes the associated costs from gripping tubular 18.

The jaw assembly 213 has a first jaw 279 and a second jaw 216. The first jaw 279 has a pipe-contacting surface 220 at one end 215 thereof. The second jaw 216 has a pipe-contacting surface 222 at one end 215 thereof. The first and second jaws 279 and 216 are connected to a drive yoke 252. A first link 230 is connected to the first jaw 279 and the drive yoke 252. The first link 230 is pivotally connected at a first pivot point 232 to the first jaw 279. The first link 230 is pivotally connected at a second pivot point 270 to the drive yoke 252. A second link 238 is connected to the second jaw 216 and to the drive yoke 252. The second link 238 is connected at a first pivot point 240 to the second jaw 216. The second link 238 is pivotally connected at a second pivot point 260 to the drive yoke 252. An elastomeric pad is the pipe-contacting surface 220 of the first jaw 279. As such, the pipe-contacting surface 220 is slightly flexible so as to avoid any damage to the outer surface of the tubular 212. An elastomeric pad is the pipe-contacting surface 222 of the second jaw 216. The links 230 and 238 assure that there is a proper movement of the jaws 279 and 216 radially inwardly relative to the movement of the drive yoke 252. The links 230 and 238 are anchored to housing 217.

An actuator means 248 is interconnected to the first jaw 279, to the second jaw 216 and to the drive yoke 252 so as to move the tubular-contacting surfaces 220, 222 and 242 radially inwardly and simultaneously for an identical distance. The drive yoke 252 is generally an elongated longitudinal member extending toward the tubular 212. An elastomeric pad is located on the end 224 of the drive yoke 252 as the tubular-contacting surface 242. The present invention contemplates that the pipe-contacting surfaces 220, 222 and 242 can be an elastomeric pad of a gripper, a toothed die of a tong, or a roller of a spinner.

The first link 230 has a pivot point 232 at an end opposite pivot point 270. Likewise, the second link 238 has a pivot point 240 at an end opposite pivot point 260. As the drive yoke 252 moves toward the tubular 18, the links 230 and 238 cause the respective jaws 279 and 216 to rotate the pipe contacting surfaces 220 and 222 inwardly toward the outer surface of tubular 18. If the diameter of tubular 18 is smaller, then the drive yoke 252 will move further toward the tubular 18 so as to cause the jaws 279 and 216 to rotate further inwardly. The movement of the drive yoke 252 causes the tubular contacting surface 242 to contact the outer surface of tubular 18. A novel aspect of the make-up tong 110 of the present invention is that a variety of tubular diameters can be utilized without the need to change the jaws 279 and 216 of the gripping apparatus 210. The present invention automatically grips different diameters of pipe while, at the same time, assuring a centering of such pipes with minimal error. The jaws 279 and 216 have two important measurements, R1 and R2. R1 is the distance between jaw pivot points 228 and 236 and the pipe-contacting surfaces 220 and 222 of the first and second jaws 279 and 216, respectively. R2 is the distance between the first pivot points 232 and 240 of the first and second links 230 and 238, and the jaw pivot points 228 and 236 of the first and second jaws 279 and 216, respectively.

In the make-up tong 110, distance R1 is not equal to R2. Prior art is limited in that it requires R1 to equal R2. Having R1 not equal to R2 in the present invention allows the present invention to grip different diameters of tubulars while simultaneously centering with minimal error. Any number of customized variations of tubular diameter ranges can be accommodated by geometrically solving for the optimum size of links 230 and 238 and appropriately sizing the distances R1 and R2 of the jaws 279 and 216 so as to provide the best mechanical advantage for the space available. Sizing the make-up tong 110 of the present invention in this manner allows the make-up tong 110 to grip with zero centering error for any two tubular reference diameters and nearly zero error for any tubular diameter between the reference diameters and just less than the smaller reference diameter and just more than the larger reference diameter. The apparatus 100 of the present invention achieves zero centering error for any two tubular diameters. The present invention contemplates that any range of diameters would have a large diameter that is several times the value of the small diameter, and wherein this range of tubular diameters would have exactly zero centering error for at least two specific sizes of pipe. The present invention also is unlimited in the geometry relative to the distances R1 and R2. That is, R1 and R2 can be any values where R1 is not equal to R2.

First link 230 is pivotally connected to the drive yoke 252 at second pivot point 270. Link 230 angles outwardly to first pivot point 232, where the first link 230 is pivotally connected to the first jaw 279. Likewise, the second link 238 is pivotally connected to the drive yoke 252 at second pivot point 260 and angles outwardly to first pivot point 240, where the second link 238 is pivotally connected to the second jaw 216. The outward angle of links 230 and 238 uses less space than prior art gripping apparatuses that have links extending parallel to the length of the gripper. Thus, the make-up tong 110 of the present invention can be used in smaller spaces than prior art gripping apparatus. The links 230 and 238 move both laterally and longitudinally, as opposed to only longitudinally.

When it is desired to release the tubular 18, it is only necessary for the piston-and-cylinder assembly of actuator means 248 to move rearwardly. This serves to cause the tubular-contacting surfaces 220, 222 and 242 of the first jaw 279, second jaw 216, and drive yoke 252, respectively, to move radially outwardly away from the outer surface of the tubular 212 so as to properly release the tubular 212 in a desired location. Further movement of the piston-and-cylinder assembly 54 of the actuator means 248 rearwardly of the make-up tong 110 will cause the jaws 279 and 216, along with the drive yoke 252, to move the tubular-contacting surfaces 220, 222 and 242 further away from each other so that this opening will allow the introduction of another tubular 212. Through the use of the present invention, a variety of tubular diameters can be utilized without the need to change the gripping make-up tong 110. The make-up tong 110 of the present invention automatically grips different diameters of tubular while, at the same time, assuring a proper centering of such tubulars. The size of the links 230 and 238, along with the relationship between the respective pivot points 232, 270, 240, and 260, is engineered so as to assure such simultaneous movement.

Figure 8:
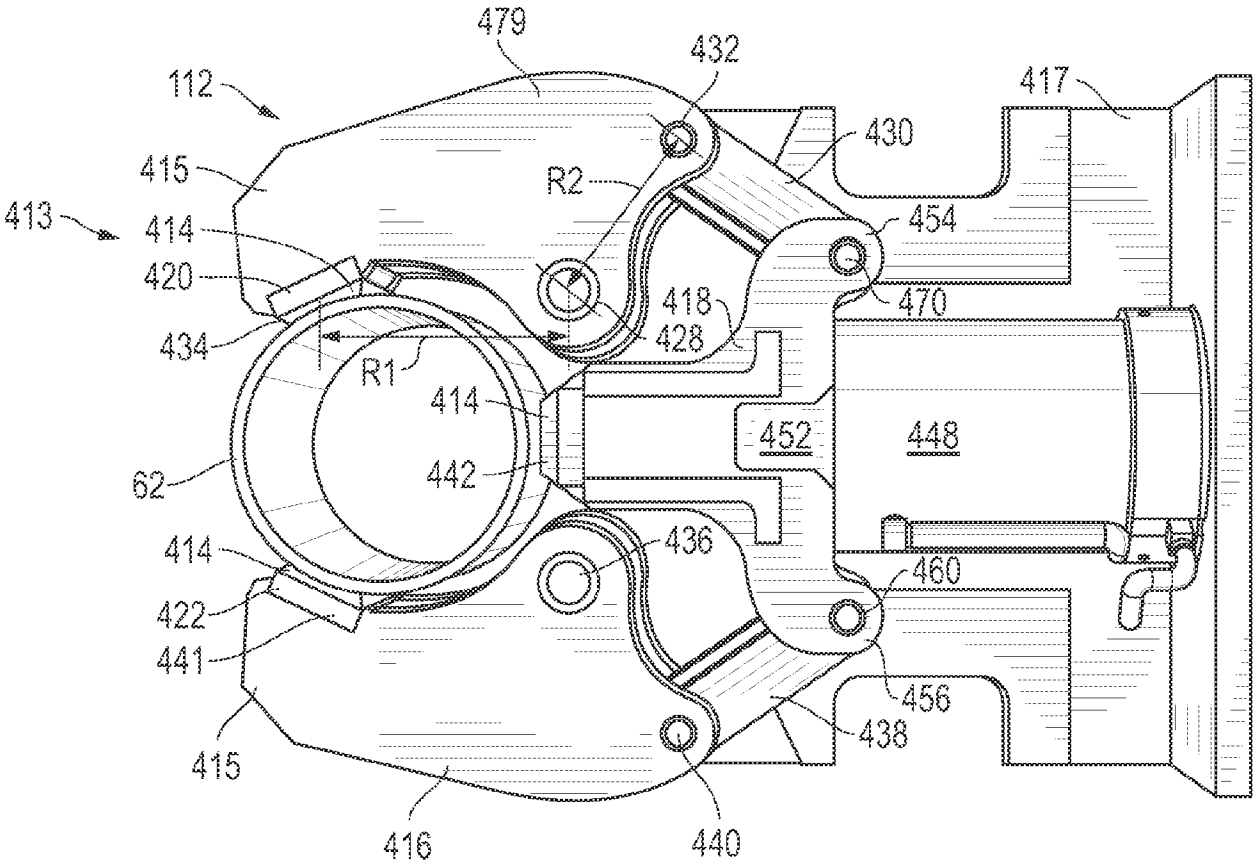
FIG. 8 shows a top perspective view of the back-up tong of the apparatus of the present invention.

Referring to FIG. 8, there is shown a top perspective view of the back-up tong 112 of the apparatus 100 of the present invention. The back-up tong 112 is structurally similar to the make-up tong 110, except that the back-up tong 112 does not have a rotating means. As discussed earlier, the back-up tong 112 is connected to a pivoting means 113. The back-up tong 112 has a jaw assembly 413. The jaw assembly 413 has a first jaw 479 and a second jaw 416. Located on the ends 415 of the jaw assembly 413 are tubular-contacting surfaces 414. The tubular-contacting surface 414 of the first jaw 479 is a gripper surface 434. The tubular-contacting surface 414 of the second jaw 416 is a gripper surface 441. The jaw assembly 413 is connected to a drive yoke 452. The first jaw 479 of the jaw assembly 413 is connected to the drive yoke 452 by a first link 430. The second jaw 416 of the jaw assembly 413 is connected to the drive yoke 452 by a second link 438. The first link 430 is connected to the first jaw 479 at a first pivot point 432. The first link 430 is connected to the drive yoke 452 at a second point 470. The second link 438 is connected to the second jaw 416 at the first pivot point 440. The second link 438 is connected to the drive yoke 452 at a second point 460. The first jaw 479 is connected to the housing 417 at pivot point 428. The second jaw 416 is connected to the housing 417 at pivot point 436. The drive yoke 452 also has a tubular-contacting surface 414 located at an end 424. The tubular-contacting surface 414 of drive yoke 452 is a gripper surface 442. The drive yoke 452 is connected to an actuator means 448. The actuator means 448 moves the drive yoke 452 forwards and backwards so as to open and close the jaw assembly 413 around the outer surface of tubular 62. The actuator means 448 resides within the housing 417. Distances R1 and R2 are comparable to the distances R1 and R2 of the make-up tong 110.

The foregoing disclosure and description of the invention is illustrative and explanatory thereof. Various changes in the details of the illustrated construction can be made within the scope of the present invention without departing from the true spirit of the invention. The present invention should be limited only by the following claims and their legal equivalents.

We claim:

1. An apparatus for connecting or disconnecting a first tubular member and a second tubular member at a wellhead, the apparatus comprising:

a frame movable between a first position adjacent the wellhead and a second position away from the wellhead;

a first gripping member connected to a side of the frame and extending outwardly therefrom, the first gripping member suitable for applying a torque to the first tubular; and a second gripping member movably connected to the frame so as to be movable relative to the first gripping member, between a stored position away from the wellhead on an opposite side of the frame, and a deployed position at the wellhead, the second gripping member suitable for applying a torque to the second tubular.

2. The apparatus of claim 1, the first gripping member suitable for applying a torque to the first tubular in a direction opposite to the torque applied to the second tubular by the second gripping member.

3. The apparatus of claim 1, the first gripping member positioned directly above the second gripping member when the second gripping member is in the deployed position.

4. The apparatus of claim 1, further comprising:

a spinner connected to the frame and extending outwardly therefrom, the spinner suitable for rotating the first tubular member.

5. The apparatus of claim 4, the spinner having a first spinner surface and a second spinner surface thereon, the spinner having a first motor positioned above a first jaw thereof, the spinner having a second motor positioned above a second jaw thereof, the first motor mechanically connected to the first spinner surface, the second motor mechanically connected to the second spinner surface.

6. The apparatus of claim 1, the frame having a first side and a second side opposite the first side, the second gripping member extending outwardly of the first side in the deployed position, the second gripping member being at the second side in the stored position.

7. The apparatus of claim 1, the second gripping member comprising:

a gripper;

an arm connected to a backside of the gripper, the arm pivotally connected to the frame; and a pivoting assembly for moving the arm between the stored position and the deployed position.

8. The apparatus of claim 1, each of the second gripping members comprising:

a first jaw having a tubular-contacting surface;

a second jaw having a tubular-contacting surface;

a drive yoke having a tubular-contacting surface at an end thereof; and an actuator connected to the drive yoke, the drive yoke being connected to the first jaw and to the second jaw, the actuator suitable for moving the first jaw and the second jaw and the drive yoke such that the tubular-contacting surfaces thereof move radially inwardly for a substantially identical distance.

9. The apparatus of claim 1, further comprising:

a structural member; and an arm connected to the structural member and extendable outwardly therefrom, the frame being connected to the arm opposite the structural member.

10. The apparatus of claim 9, the structural member being pivotable between a horizontal orientation and an upwardly extending orientation, the arm extending outwardly of the structural member when the structural member is in the upwardly extending orientation.

11. The apparatus of claim 10, the first gripping member extending horizontally from the frame when the structural member is in the upwardly extending position.

12. An apparatus for connecting or disconnecting a threaded connection between a first tubular and a second tubular at a wellhead, the apparatus comprising:

a rotating structural member rotatable between a first position and a second position;

a lever pivotally connected to the rotating structural member, the lever having a first portion extending outwardly with respect to a second portion;

an arm pivotally connected to the first portion of the lever and extending outwardly therefrom when the rotating structural member is in the second position;

a frame connected to an end of the arm opposite the lever;

a first gripping member extending outwardly of a side of the frame opposite the arm, the gripping member suitable for applying a rotational force to the first tubular; and a second gripping member movably connected to the frame so as to be movable relative to the first gripping member, between a stored position away from the wellhead, and a deployed position above the wellhead, the second gripping member suitable for applying a torque to the second tubular.

13. The apparatus of claim 12, the first gripping member being a spinner suitable for rotating the first tubular member.

14. The apparatus of claim 12, the first gripping member being a tong suitable for applying a torque to the first tubular in a direction.

15. The apparatus of claim 14, further comprising:

the second gripping member being a back-up tong connected to the frame and extending below the first gripping member, the back-up tong suitable for applying a torque to the second tubular in a direction opposite to the direction that the first gripping member applies torque to the first tubular.

16. The apparatus of claim 15, the back-up tong comprising:

a second gripper;

a pivoting assembly connected to a backside of the second gripper, the pivoting assembly pivotally connected to the frame; and a means for moving the between the stored position and the deployed position.

17. The apparatus of claim 15, further comprising:

a spinner extending outwardly of the frame in a position directly above the first gripping member, the spinner suitable for rotating the first tubular member.

18. The apparatus of claim 12, further comprising:

a skid pivotally connected to the rotating structural member;

a link pivotally connected to the second portion of the lever; and a brace having an end pivotally connected to the rotating structural member and an opposite end pivotally connected to the arm.

19. The apparatus of claim 12, the first gripping member comprising:

a first jaw having a tubular-contacting surface;

a second jaw having a tubular-contacting surface;

a drive yoke having a tubular-contacting surface; and an actuator connected to the drive yoke, the actuator for moving the first jaw and the second jaw and the drive yoke such that the tubular-contacting surfaces thereof move radially inwardly for a substantially identical distance.

* * * * *